United States Patent [19]

De Spiegeleer

[11] 4,105,175

[45] Aug. 8, 1978

[54] RAILWAY SWITCHING POINTS

[75] Inventor: Michel R. De Spiegeleer, Hombeek, Belgium

[73] Assignee: Gestivalmo Societe Anonyme Holding, Luxembourg, Luxembourg

[21] Appl. No.: 811,351

[22] Filed: Jun. 29, 1977

[30] Foreign Application Priority Data

Jul. 1, 1976 [LU] Luxembourg ..... 75283

[51] Int. Cl.[2] ..... E01B 7/08

[52] U.S. Cl. ..... 246/430; 246/380; 246/392; 246/453; 238/45

[58] Field of Search ..... 246/430, 432, 433, 380, 246/392, 453; 238/29, 45, 48, 284, 351; 308/3 C, 3 CH

[56] References Cited

U.S. PATENT DOCUMENTS

| | | | |
|---|---|---|---|
| 752,517 | 2/1904 | Carter | 246/453 |
| 1,599,733 | 9/1926 | Williams | 246/453 |
| 3,737,657 | 6/1973 | Dohse | 246/392 |

*Primary Examiner*—Trygve M. Blix
*Assistant Examiner*—Reinhard J. Eisenzopf
*Attorney, Agent, or Firm*—Sughrue, Rothwell, Mion, Zinn and Macpeak

[57] ABSTRACT

The invention relates to a device for a switching point of a railway track, said switching point comprising two movable tongue-rails controlled in such a manner that their ends may be brought in contact with line-rails, or be separated therefrom, by a sliding movement over bearings carried by sleepers, said device being placed in the space between two bearings and comprising a sliding part or piece supporting at least one tongue-rail on a self-lubricating sliding surface, said part or piece being influenced by elastic springs or the like to lift the tongue-rail or rails which it supports with respect to said bearings, in such a manner that said tongue-rail or rails are not in contact with said bearings during the sliding movement of the tongue-rail or rails, but come directly into contact with the bearings under the influence of the load of a railway vehicle passing over said tongue-rail or rails.

13 Claims, 9 Drawing Figures

RAILWAY SWITCHING POINTS

PRIOR ART

The splitting of lines of railway rails is known to be obtained by operating moving rails called "tongue-rails" or "switch-rails" which may be at will brought into contact with the adjacent rails called "main rails" or "running-rails" and separated therefrom by a sliding movement of the tongue-rails over bearings or bearing plates, supported by sleepers or ties.

The control of the tongue-rails movement is accomplished either on the spot by means of counterweighted levers or from a distance by mechanical and/or electric means.

In order to assure an adequate movement of the tongue-rails of the switching points, in spite of all atmospheric conditions, the bearings or bearing plates must be frequently lubricated. Thus an abundant workmanship is required in the railway systems to assure a constant sufficient lubrication of the bearings or sliding plates of the numerous switching points which such railway systems comprise.

BRIEF DESCRIPTION OF THE INVENTION

It is one object of the present invention to provide a device intended to be associated to a switching point and arranged in such a manner that the movement of the tongue-rails with respect to the main rails does not take place any more in contact with the bearings or sliding plates of the switching point, so that the bearings or bearing plates need no lubrication any more.

It is a further object of the invention to provide a device of the type mentioned in the above paragraph, which may be put in place between two sleepers of a railway line, at the point where a switch is provided, or on the sleepers themselves, beside existing bearings, whereby it is not necessary to take down the switching point, nor any part of the existing line, so that said putting in place may be achieved without interrupting the traffic on the line in question.

According to the invention, the device is placed in the space between bearings and comprises a sliding part or piece supporting at least one tongue-rail by means of a self-lubricating sliding surface, said part or said piece being influenced by elastic means, so as to lift the tongue-rail or rails which it supports, with respect to said bearings, in such a manner that said tongue-rail or rails are not in contact with said bearings during the sliding movement of the tongue-rail or rails, but come directly into contact with the bearings under the influence of the load of a railway vehicle passing over said tongue-rail or rails.

According to one feature of the invention the elastic means lifting the tongue-rail or rails consist of springs which may be of various types, such as plate-springs, coil-springs, dish or disc springs and the like, or of devices having a similar function to that of a spring such as dash-pots, jacks and the like.

The sliding piece or part of the device according to the invention having a self-lubricating surface is advantageously made of a plastic material having an as low as possible friction coefficient, such as a so-called "self-lubricating" plastic material, whereby said plastic material may be selected from thermoplastic materials, such as polyamides, polyacetals, polyethylene and polybutylene terephthalates, polyethylene, polypropylene, polytetrafluoroethylene, polyvinyl chloride, polyvinylidene fluoride, polycarbonates, polystyrene, acrylonitrile-butadiene-styrene copolymers, cellulose acetate, polymethylmetacrylate, etc.; thermosetting materials, such as phenol-formaldehyde resins, cresol-formaldehyde resins, melamine-formaldehyde resins, polyesters resins, etc.; elastomers such as polyurethanes; or also composite materials, such as mixtures of polyacetals and of polytetrafluoroethylene, as well as of porous bronze.

According to another feature of the invention, the sliding piece or part, having a self-lubricating surface, is advantageously fixed to a support, preferably a metal support. Thus, this sliding piece or part may be in the form of a plate sticked, or fixed in another manner, to the support, or in the form of a sectional piece gripping round at least a part of the support.

According to still another feature of the invention, the sliding piece or part, having a self-lubricating surface, shows a series of grooves extending preferably obliquely from the one edge to the other edge of said sliding piece or part.

In one embodiment of the device according to the invention, the support of the sliding part or piece, having a self-lubricating surface, is carried by at least one spring bearing upon a seating intended to be fixed to at least one of the line-rails of the switching point or on the sleepers themselves, beside the existing bearings.

In another embodiment of the device according to the invention, the support of the sliding part or piece, having a self-lubricating surface, consists of a spring or forms itself a part of a spring and constitutes, for example, one of the legs of a spring having substantially the shape of a U, lying on its other leg, said latter leg being supported by the above mentioned base-plate or seating.

DETAILED DESCRIPTION OF THE INVENTION

Other features and details of the invention will appear from the following detailed description in which reference is made to the drawings attached hereto, representing, by way of purely illustrative and non-limiting examples, three embodiments of a device according to the invention.

DRAWINGS

In these drawings:

FIG. 1 is a partial schematic top view of a switching point of a railway line;

FIG. 2 is a side view in vertical section showing a first embodiment of the device according to the invention;

FIG. 3 is a side view in vertical section showing a second embodiment of the device according to the invention;

FIG. 4 is a view in section according to line III—III of FIG. 3;

FIG. 5 is a top view of a third embodiment of the device according to the invention;

FIG. 6 is a side view in vertical section in the direction of the arrowhead Y on FIG. 5;

FIG. 7 is a view in vertical section according to line VII—VII of FIG. 5; and FIGS. 8 and 9 show, in perspective, respectively from the top and from the bottom, one embodiment of a sliding piece, having a self-lubricating surface.

In these figures, the same reference numerals indicate identical elements.

Figure 1:
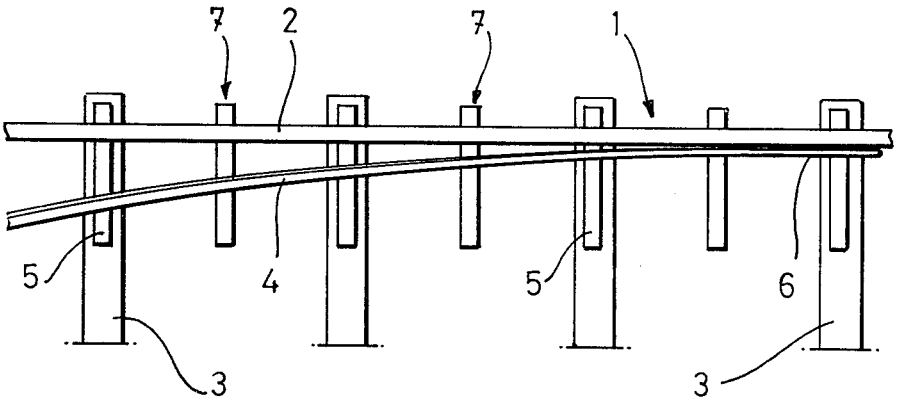
FIG. 1 shows a part of a switching point indicated, as a whole, by the reference numeral 1, comprising a fixed rail 2 forming one of the line-rails or running-rails of the switching point, said line-rail being fixed to sleepers 3. The reference numeral 4 indicates a tongue-rail or needle which may be caused to slide on bearings or sliding plates 5, supported by the sleepers 3, in such a way that the point or blade of the tongue-rail 4 is brought into contact with the line-rail 2 or separated therefrom, when the switching point is operated by known control means (not represented).

The present invention relates to a device indicated as a whole, by the reference numeral 7 and intended to be placed between or on the sleepers 3 supporting the bearings 5, but beside these latter, in such a manner that there is never any contact between said device and the bearings as shown in FIG. 1, whereby the various devices 7 according to the invention may be put in place without necessitating to take down the switching point, and therefore, interrupt the railway traffic.

Figure 2:
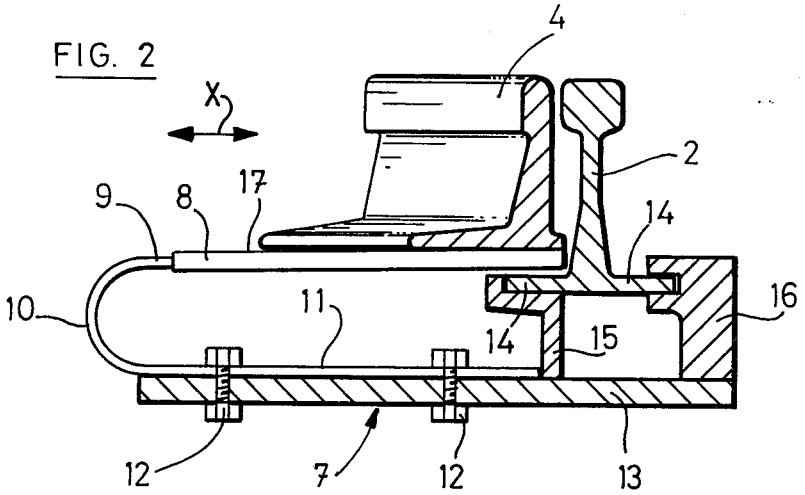

In a first embodiment of the device according to the invention, represented in FIG. 2, the tongue-rail 4 rests on a sliding piece 8 having a self-lubricating surface, supported by a leg 9 of a spring plate 10 having the shape of a U lying on its other leg 11. Said other leg 11 is fixed by means of bolts 12 to a base-plate 13, itself fixed to the heel 14 of the line-rail 2 by means of the pieces 15 and 16, integral with the base plate 13.

As can be seen in FIG. 2, the tongue-rail 4 is somewhat lifted with respect to the line-rail 2, owing to the U-shaped spring 10, so that said tongue-rail is not in contact anymore with the sliding plates or bearings 5 carried by the sleepers 3, in such a manner that, when the switching point 4 is moved in the direction indicated by the arrowheads X in FIG. 2, it slides over the upper surface 17 of the sliding piece 8, without being in contact with the bearings 5.

The sliding piece 8 consists, for instance, of a sleeve or sheath of plastic material, for instance of polytetrafluoroethylene and/or of polyacetal, gripping round the upper leg 9 of the spring 10, whereby the surface 17 of said piece 8 is self-lubricating, that is to say that it presents a very low friction coefficient, so that it is not necessary to lubricate said surface.

As long as no railway vehicle passes over the switching point, the tongue-rails 4 thereof are maintained lifted by a few millimeters owing to the springs 10 of the device according to the invention, whereas under the influence of the weight of a railway vehicle passing over the switching point, the tongue-rails 4 thereof are lowered, thereby opposing to the action of the springs 10 of the devices according to the invention, until said tongue-rails come into contact with the existing bearings which then support the entire load of the railway vehicle, thereby neutralizing the action of the springs 10.

Figure 3:
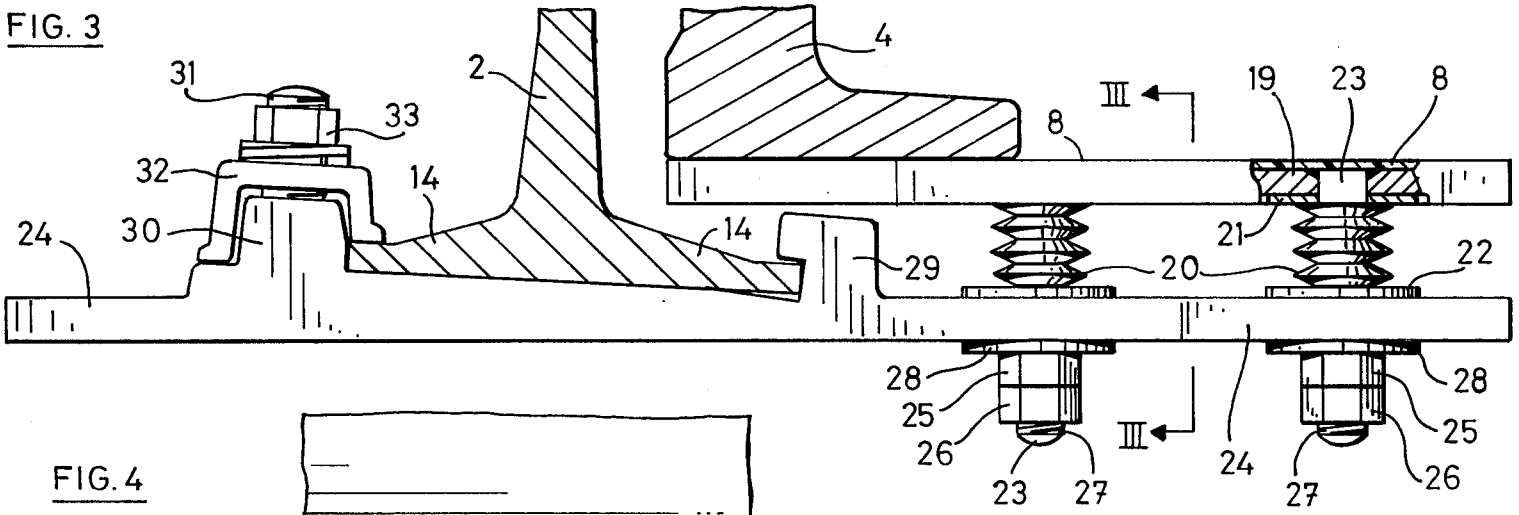
Figure 4:
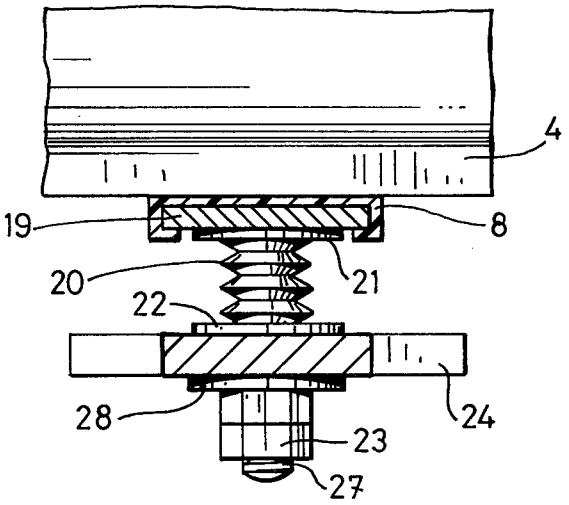

In the second embodiment of the device according to the invention represented in FIGS. 3 and 4, the tongue-rail 4 is supported by a sliding piece 8 made of plastic material having a self-lubricating surface, the cross-section of which, (indeed similar to that of the sliding piece shown in FIG. 2) is represented on FIG. 4. This latter sliding piece 8 is pulled over a steel support plate 19. Disc-type springs 20 support elastically the plate 19 and the sliding piece 8 carried by said plate 19.

Said disc-springs 20 bear upon upper washers 21 and lower washers 22, whereas rods 23, fixed to the plate 19 act as guides for the springs 20. The rods 23 pass through a base plate 24, a screw-nut 25 and a counter-nut 26, screwed on the threaded end 27 of the rods 23, a washer 28 being placed between the screw-nut 25 and the inner face of the base plate 24.

The base plate 24 shows a first projection 29 in the form of a clamp grip beside the heel 14 of the line-rail 2. A second projection 30 of the base plate 24 in which a threaded rod 31 is sealed is used to fix the base plate 24 to the other side of the heel 14 of the line-rail 2. Therefor the projection 30 is covered with a stirrup 32 which is pressed against the heel 14 by means of a nut 33, screwed on the threaded rod 31.

The downward movement of the tongue-rail 4, in opposition to the action of the disc-springs 20, is limited by the upper surface of the existing slide-bearings.

Exactly as in the embodiment shown in FIG. 2, the device shown in FIGS. 3 and 4 which is set aside from the bearings 5, maintains the tongue-rail 4 lifted by means of the springs 20, as long as the tongue-rail is not lowered under the influence of the weight of a vehicle, so that the side movement of the tongue-rail 4 performs only in contact with the self-lubricating surface of the sliding piece. On the contrary, as long as a railway vehicle passes over the tongue-rail 4, the load thereof is not supported by the sliding piece 8 and by the springs 20, but indeed by the bearings 5.

Figure 5:
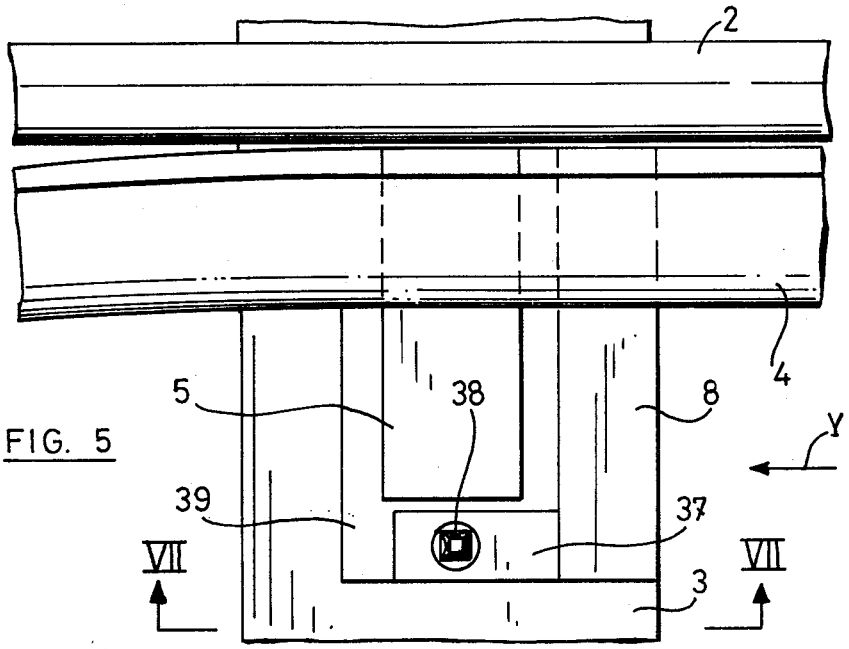
Figure 6:
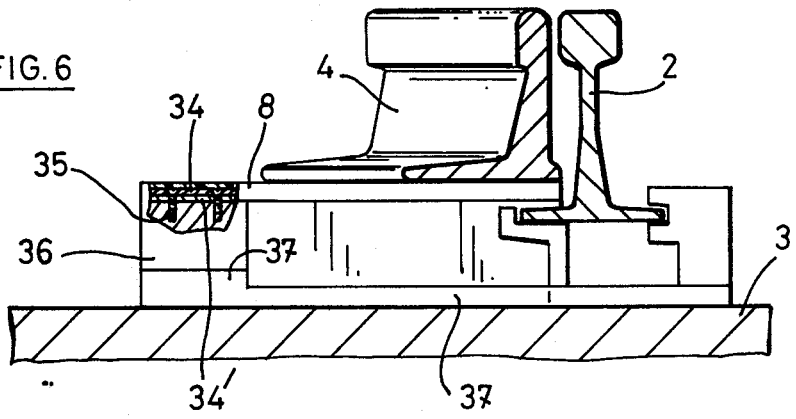
Figure 7:
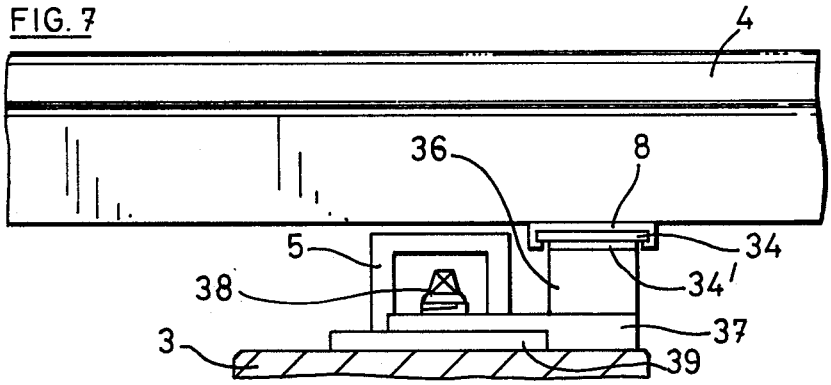

In a third embodiment of the device according to the invention, shown in FIGS. 5, 6 and 7 the device is placed on a sleeper 3, beside a steel bearing or sliding plate 5.

In this third embodiment the tongue-rail 4 bears upon a sliding piece 8 made of self-lubricating plastic and carried by two spring plates 34, 34', said spring plates 34, 34', being fixed at their extremities by means of a screw 35 to a raised part 36 of a seating 37, fixed by means of a sleeper-screw 38, to the sleeper 3. The bearing 5 applied to a base plate 39, and the seating 37 are placed beside each other on one and the same sleeper 3.

As appears in FIG. 6, the spring plates 34, 34', extend over hanging from their extremities fixed to the seating 37, so that the tongue-rail 4, supported by the sliding piece 8, is lifted with respect to the upper surface of the bearing 5, as long as the tongue-rail is not subjected to the load of a railway vehicle. The sliding of the tongue-rail 4 tending to bring it nearer to or to remove it from the line-rail 2 only takes place over the self-lubricating sliding piece 8, thereby avoiding any contact between said tongue-rail and the bearing 5. On the contrary, when a railway vehicle drives over the tongue-rail 4, the latter is lowered until it comes in contact with the bearing 5, which thus takes over the entire load of said vehicle, whereby the spring plates 34, 34', are then inoperating.

Figure 8:
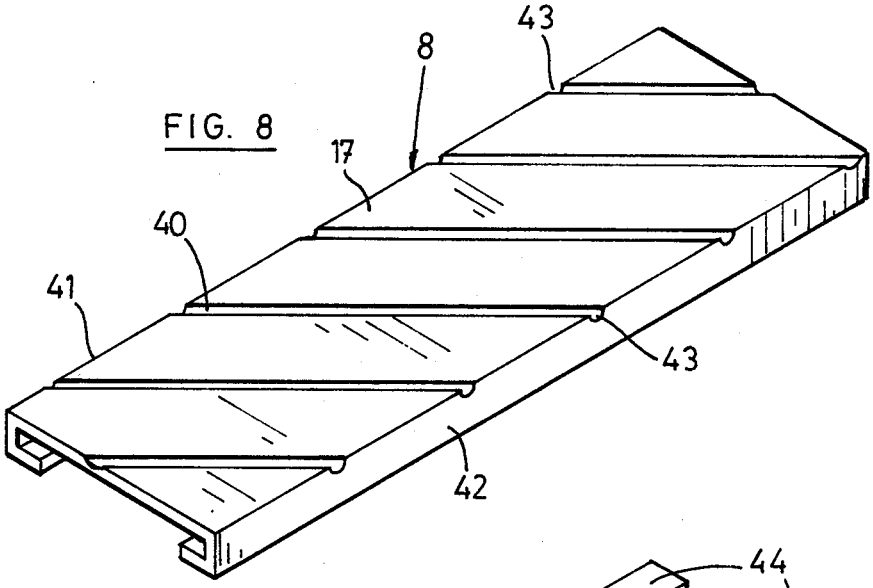
Figure 9:
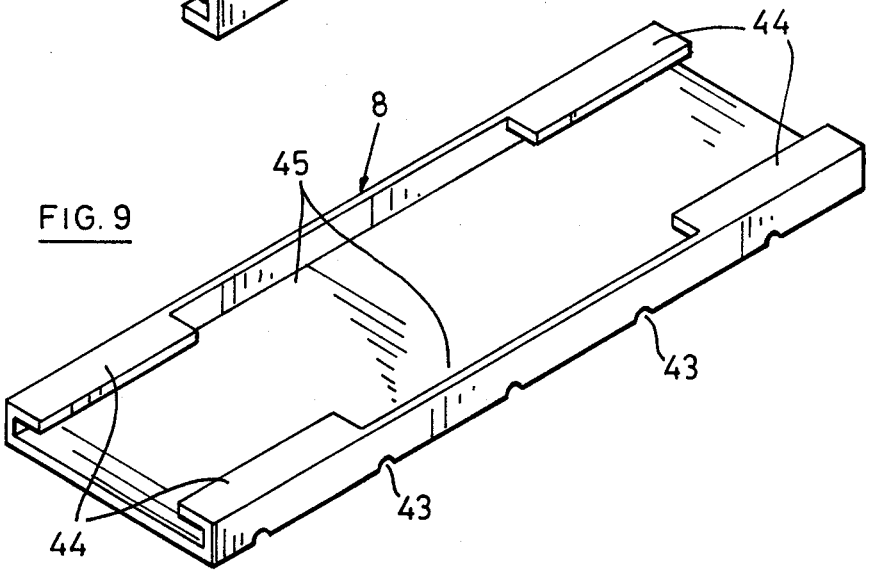

FIGS. 8 and 9 show a sliding piece 8, the self-lubricating surface 17 of which presents a series of grooves 40 extending obliquely from one side edge 41 to the other side edge 42 of the piece. These grooves 40 act to collect the dust which has deposited on the surface 17. When the tongue-rail 4 slides over the surface 17, the dust is pushed into the grooves 40 and, when said dust has gathered therein, it is evacuated through the open ends 43 of these grooves. Thus, the self-lubricating surface 17 is kept clean and remains perfectly smooth, allowing an easy sliding of the tongue-rail 4.

As can be seen in particular in FIG. 9, the sliding piece 8, intended to be pulled over a support, is provided at its lower part, with two opposed flanges 44 which are interrupted over a part of their length, as shown under reference numeral 45.

In order to prevent that the sliding piece 8 should disengage itself inadvertantly from its support, the piece 8 may be fixed to the support for example by means of pegs or projections borne by the support and cooperating with the flanges 44, so as to prevent the piece from sliding from the support when it has been attached thereto.

It should be clear that the invention is not limited to the details described hereabove and that numerous modifications may be effected to said details without leaving the scope of the invention.

Thus, instead of springs 10, 20, 34, 34', one may consider the use of elastic pads made of rubber, or dashpots, or even hydraulic jacks.

The number of devices according to the invention equipping a switching point depends upon the length of the tongue-rails thereof.

It must be clear that two devices according to the invention which are used to support the two parallel tongue-rails of a switching point may be placed on a common seating.

What I claim is:

1. A device for a switching point of a railway track, said switching point comprising two movable tongue-rails controlled in such a manner that their ends may be brought in contact with line-rails, or be separated therefrom, by a sliding movement over bearings carried by sleepers, said device being placed in the space between two bearings and comprising a sliding part or piece supporting at least one tongue-rail by means of a self-lubricating sliding surface, said part or piece being influenced by elastic means, so as to lift the tongue-rail or rails which it supports with respect to said bearings, in such a manner that said tongue-rail or rails are not in contact with said bearings during the sliding movement of the tongue-rail or rails, but come directly into contact with the bearings under the influence of the load of a railway vehicle passing over said tongue-rail or rails.

2. A device according to claim 1, in which the sliding part or piece is made of plastic material.

3. A device according to claim 2 in which the sliding part or piece is fixed to a support.

4. A device according to claim 3, in which the support bears upon at least one spring.

5. A device according to claim 3, in which the support consists of a spring or forms itself a part of a spring.

6. A device according to claim 3, in which the support constitutes one of the legs of a U-shaped spring disposed horizontally such that it lies on its other leg.

7. A device according to claim 6, in which the spring rests upon a seating intended to be fixed to at least one of the line-rails of the switching point.

8. A device according to claim 3, in which the support consists of at least one extended, overhanging spring plate having one of its ends fixed to a seating.

9. A device according to claim 8, in which the seating is fixed to a sleeper.

10. A device according to claim 9, in which the sliding piece extends beside a bearing, on one and the same sleeper.

11. A device according to claim 1, in which the movement of the tongue-rail or rails supported by the sliding part or piece is limited in the downward direction by said bearings.

12. A device according to claim 1, in which the sliding piece has, in its self-lubricating surface, a series of grooves intended to collect the dust and other materials which may deposit on said surface.

13. A device according to claim 12, in which said grooves extend obliquely from one edge of the sliding piece to the other.

* * * * *